US006830727B1

(12) United States Patent
Mahler et al.

(10) Patent No.: US 6,830,727 B1
(45) Date of Patent: Dec. 14, 2004

(54) METHOD FOR STOCKING AND PRESERVING GREEN ROUND WOOD AND SAWN TIMBER

(75) Inventors: Gerold Mahler, Kirchzarten (DE); Christoph Richter, Dresden (DE); Martin Gross, Freiburg (DE); Andreas Weber, Dresden (DE); Thomas Maier, Gundelfingen (DE); Juergen Koenig, Tharandt (DE)

(73) Assignee: Technische Universitaet Dresden, Dresden (DE)

( * ) Notice: Subject to any disclaimer, the term of this patent is extended or adjusted under 35 U.S.C. 154(b) by 0 days.

(21) Appl. No.: 09/319,126

(22) PCT Filed: Dec. 19, 1997

(86) PCT No.: PCT/DE97/02966

§ 371 (c)(1),
(2), (4) Date: Aug. 23, 1999

(87) PCT Pub. No.: WO98/26907

PCT Pub. Date: Jun. 25, 1998

(30) Foreign Application Priority Data

Dec. 19, 1996 (DE) ..... 196 52 951

(51) Int. Cl.[7] ..... F26B 7/00

(52) U.S. Cl. ..... 422/40; 44/541; 34/380; 34/417

(58) Field of Search ..... 422/40; 34/380, 34/417, 201; 44/541

(56) References Cited

U.S. PATENT DOCUMENTS 2,617,202 A 11/1952 Reedy
3,431,061 A * 3/1969 Chase et al. ..... 422/40
5,363,568 A 11/1994 Cloer
5,447,686 A * 9/1995 Seidner ..... 422/26
5,718,851 A * 2/1998 Wadas, Jr.
5,725,613 A * 3/1998 Reeves et al.
6,063,336 A * 5/2000 Meredith et al. ..... 422/40 X

FOREIGN PATENT DOCUMENTS

| | | |
|---|---|---|
| DE | 2857355 | 5/1980 |
| DE | 3434551 | 4/1985 |
| DE | 267188 | 4/1989 |
| DE | 19652951 | 6/1998 |
| GB | 2093081 | 8/1982 |
| JP | 6-39811 A * | 2/1994 |
| WO | 97/27034 | 7/1997 |

OTHER PUBLICATIONS

Kozlik et al. Abstract of "Changes of the atmosphere during wood decay by fungi under conditions of stopped gas diffusion," Drev. Vysk. (1974), 19(4), pp. 169–179.*
1992 "Preservation of Wood by Protective Gas" by Von Gerold Mahler pp. 1024–1025.

* cited by examiner

*Primary Examiner*—Elizabeth McKane
(74) *Attorney, Agent, or Firm*—Jordan and Hamburg LLP

(57) ABSTRACT

The invention relates to a method for stocking and preserving green round wood and sawn timber, which is stored in an airtight and lighttight sealing cover. The oxygen inside the cover is decomposed by the respiratory process of fungi, bacteria and wood cells that are still alive, thereby forming $CO_2$ and $H_2O$. Fermentation processes also lead to the decomposition of hemicelluloses and saccharides which are converted to organic acids and $CO_2$. The oxygen content in the cover is less than 0.1 vol. % after an adjustment time of 3 to 10 days of total stocking, while said $CO_2$ content rises to more than 21 and up to 40 vol. %. This method enables green round wood a swan timber to be stocked over long periods without wastage or environmental damage.

23 Claims, 3 Drawing Sheets

METHOD FOR STOCKING AND PRESERVING GREEN ROUND WOOD AND SAWN TIMBER

BACKGROUND OF THE INVENTION

The invention relates to a method for stocking and preserving green round wood and sawn timber, of both softwood and hardwood, over long periods without loss of quality.

Conventional general preserving methods concern mainly food which is sterilized by heating in the absence of air (bottling, canning), or fumigated in dry condition with carbon dioxide (protection of grain from pests), or gassed with protective gases having special compositions (storing and ripening of fruit in a nitrogen/carbon dioxide atmosphere), or cleared from insects under pure nitrogen (restoration of wood articles whose pigments would be attacked by carbon dioxide).

Methods used so far for preserving green round wood are based on storage in water or sprinkling with water. A wood moisture content of over 100% is aimed at in order to prevent fungal growth. Drawbacks are the high water consumption and the ground-water pollution due to wood substances, in connection with different moisture content in the interior of the wood stack, which results in fungal attack (Armillariella species).

Further, round wood and sawn timber can be preserved for a time using insecticides and fungicides. The application of pesticides involves endangering nature and mankind.

A safe method of preservation is to convert and season the wood as soon as possible. This, however, demands extensive conversion and seasoning capacities to be kept in reserve, in order to be capable of quickly processing large quantities of round wood (wind-fallen wood and other problems).

Also known are attempts to preserve green round wood in dry stacks. This method, however, involves high risks of fungal and insect attacks.

From DE-OS 28 57 355 and DEOS 34 34 551, methods are known of influencing the wood properties by means of fungal cultures.

According to DE-OS 28 57 355, a method is known of microbiologically modifying softwood using micro-organisms. These micro-organisms selectively modify the softwood whereby the temperature, the moisture content of the wood, the $O_2$ content and the $CO_2$ content are controlled in due consideration of the micro-organisms.

In DE-OS 34 34 551, the round wood is deliberately discolored by treatment with wood-destroying fungi. Discoloration occurs at those places where the fungus culture has been applied. Also the application of several fungus cultures is described which is associated with a beneficial boundary layer formation.

In the paper Mahler G.: Konservierung von Holz mit Schutzgas (Preservation of Wood Using Protective Gas), AFZ 47 (1992) 19, pp. 104–1025, experiments are reported to preserve wood using a protective gas. In these experiments wood with standardized dimensions was wrapped in silo films. The stacks were fumigated with both nitrogen and carbon dioxide; in each case, the threefold gas volume compared to the wood volume was required. Thereby the oxygen content was reduced to 4–5% and this content maintained over a longer-period of time (more than 6 months). After opening of the stack a fungal coating was found on the wood that is assumed to be an antagonist, which indicates that an attack from wood-destroying fungi can be prevented by the promotion of antagonistic fungi.

Disadvantages are the fumigating demand described and the relatively high residual oxygen content.

SUMMARY OF THE INVENTION

It is the objective of this invention to develop a method that enables to stock green round wood or sawn timber of all wood species over a longer period of time without deterioration of quality and strength properties without previously having the wood sterilized, moistened, dried or treated with special protective gases.

Initially, it is certainly surprising that humid, non-debarked wood is not going moldy and not rotting under a low-exchange atmosphere. Essential to the invention, however, is that resulting from respiratory processes of wood cells that are still alive, and metabolic processes of fungi, bacteria which have been fed into the covering through the green round wood, or sawn timber, respectively, a virtually oxygen-free atmosphere, enriched with carbon dioxide, is produced.

The airtight cover ensures that, on the one hand, no oxygen can enter from the exterior and, on the other hand, no carbon dioxide can exit from the cover.

Contrary to the interpretation in Mahler, G.: Konservierung von Holz mit Schutzgas (Preservation of Wood Using Protective Gas), AFZ 47 (1992) 19, pp. 1024–1025, it is not the action of the fungal antagonists which is decisive to prevent wood-destroying fungi from growth. It is rather the very low oxygen content of less than 0.1 vol.-% that is essential for permanent storage possibility.

This low oxygen content is achieved by the fact that after the respiratory processes as in fruit storing in which $CO_2$ and $H_2O$ are released and which end with the consumption of the $O_2$, another cycle starts. In this cycle, fermentation processes occur in that additional $CO_2$ is set free so that the $CO_2$ content further rises.

The initiation of fermentation processes is another substantial advantage of the invention, compared to fruit storage. No degradation of cellulose or lignin takes place while only readily soluble sugars are degradated. Thus the strength of the round wood or timber, respectively, is remained.

The biotechnological process started after the sealing from air can be accelerated by minimization of the volume of the air within the cover.

In order to produce sealing from air, covering, advantageously a plastic film with a high diffusion resistance, is employed: To reduce the danger of leakage the film can be used in double layer. The benefit of a flexible covering consists in that the volume of the air can be minimized (by suction until the film tightly wraps the stack of wood or timber).

Sealing from air can also be obtained in purpose-prepared storehouses, containers, cargo holds, lined pits, silos, or mining tunnels.

After any short-time opening of the air-tight covering to take out some wood, or timber, respectively, the virtually oxygen-free atmosphere after resealing reproduces within a few days. The micro-organisms are able, independent of the time of the year, to reproduce those conditions that are favourable for them.

Additionally, $CO_2$ stored in the wood as a porous body and salved in the water bonded in the wood, call again be released to produce a new gas balance.

In film storage, scaling from air of the wood or timber stacks, in case of valuable (veneer) wood also of individual trunks, is achieved by a double weld at the enveloping film, or by gluing, respectively, or by clamping of the films webs straight lying on top of each other by means of strips of wood around which the film is tightly wrapped and secured with clips from unwinding.

The essential advantage of the method according to the invention is that in the preservation, storage needs no additional fumigation.

BRIEF DESCRIPTION OF THE DRAWINGS

In the following, further details of the invention will be disclosed by several examples of embodiments of the invention.

DETAILED DESCRIPTION OF THE INVENTION

In the embodiments discussed below a single or double, UV resistant plastic film with high diffusion resistance may be used as the cover or a single or double, two layered film with a black internal surface which prevents light from entering and thereby growth of algae and a with a white external surface which reflects light may be used as a cover. Films may be welded separately or simultaneously with double welds or may be bonded with each other.

Example of Embodiment 1

Figure 1:
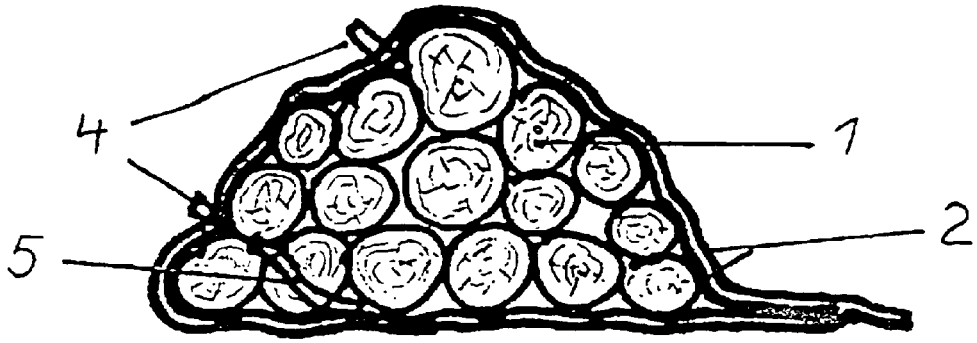
FIG. 1 is an arrangement of several round logs with welded, or bonded, respectively, double film encapsulation.
Figure 4:
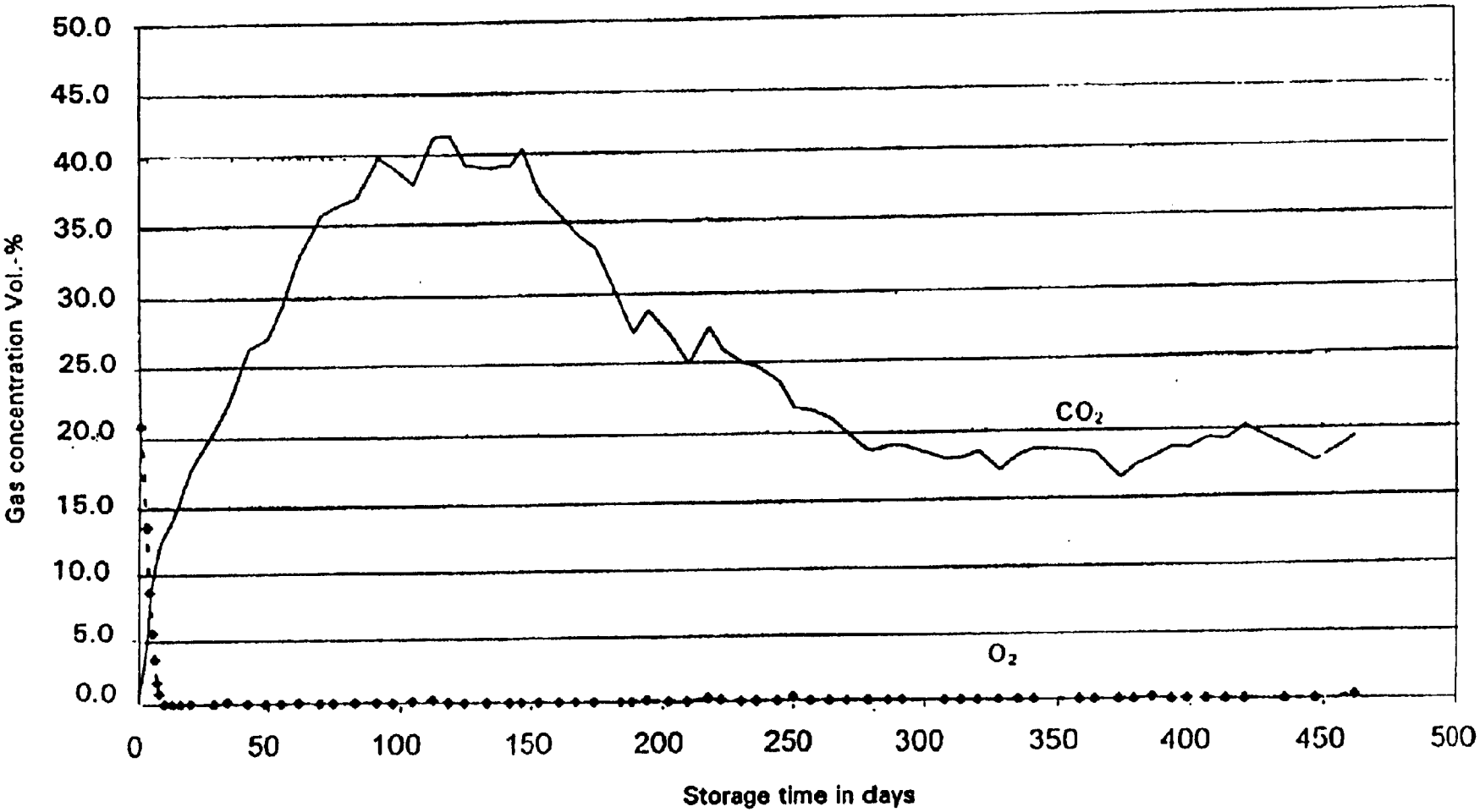
FIG. 4 is a diagram showing the gas development during storage under sealing from air.
Figure 5:
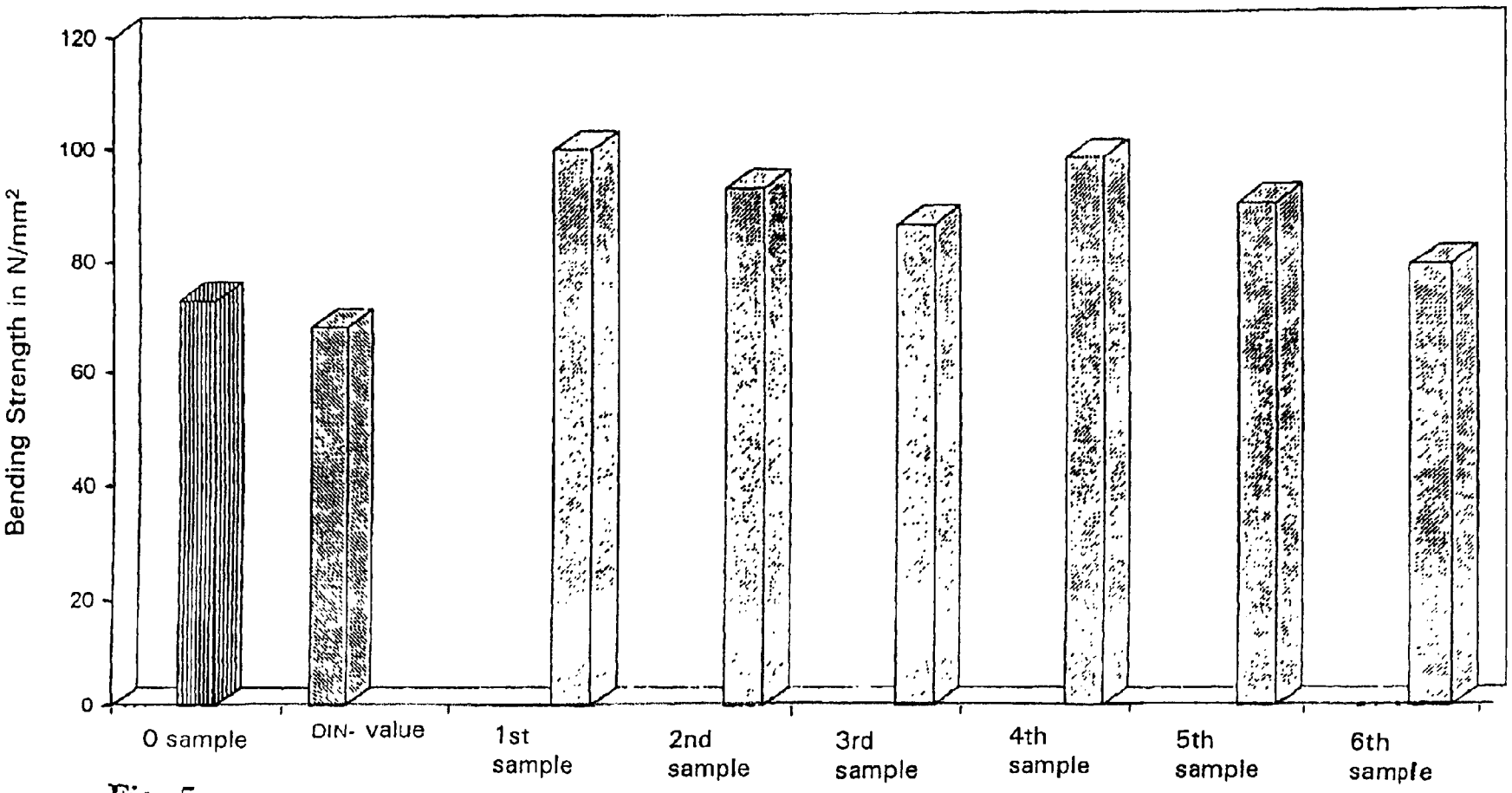
FIG. 5 is a diagram showing the bending strength during the storage process after storing under oxygen withdrawal with zero sample and DIN value.

Double-layered DUALENE (a UV resistant plastic film, a UV stabilized film made from polyethylene) films were spread on a plane surface and 30 $m^3$ of non-debarked spruce, diameter classes 15–25 cm, were placed on them. Two measuring flexible tubes were laid out in the stack and attached to the film using bulkhead fittings. According to FIG. 1, the projecting film was then drawn over the stack and both films—separate form each other—welded by a double weld seam. After about 3 days in summer, about 10 days in winter, the oxygen content reduces to under 0.1%. The carbon dioxide content levels off at about 40% (see FIG. 4). After a storage period of 24 months neither blue stain, nor red stripes, nor growth of Armillariella species could be detected. The bending strengths measured to DIN 52186 were not lower than those for green comparison samples (compare FIG. 5).

Example of Embodiment 2

Figure 2:
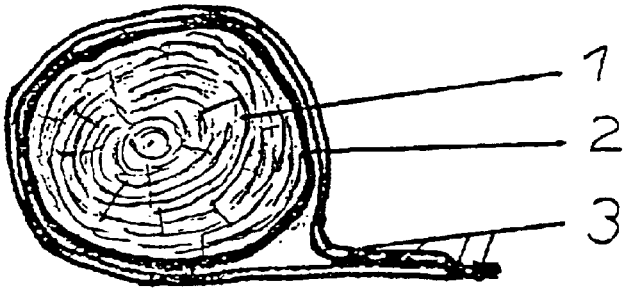
FIG. 2 is an arrangement of one round log with welded, or bonded, respectively, double film encapsulation.

1 $m^3$ of pine timber was enveloped with double dualene film, as in FIG. 2. Both film edges were clamped between strips and tightly wound around these strips. The composite thereby produced was secured from unwinding using clips. In this way, the conditions for adjustment of the gas atmosphere can be created without any weld seam using means available on the site.

Example of Embodiment 3

Figure 3:
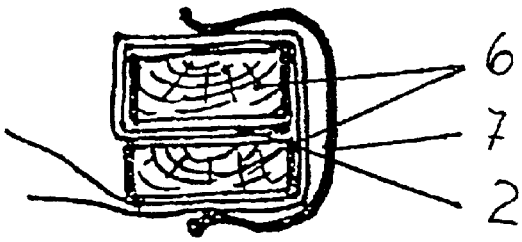
FIG. 3 is a clamping device at the film edges.

According to FIG. 3, a maple veneer trunk of 35 cm center diameter, 3 m length, was wrapped in double-layered dualene film. Near to either butt end of the trunk, a bulkhead fitting is attached. Then the films were doubly welded. After 2 weeks an atmosphere has established that contains less than 0.1% oxygen and whose carbon dioxide content is up to 30%.

Example of Embodiment 4

In order to make overseas transportation possible of green round wood without damage, the wood is stacked in airtight-sealed holds, filling the hold space as completely as possible. As the holds can already be sealed water-tightly using bulkheads, sealing from air needs be produced only on the top using air-tight or sealed hatches. In order to reduce the adjustment time, exhaust gases of the ship's diesel engine are piped to the hold as initial fumigation.

What is claimed is:

1. Method for preservation storage of green round wood and sawn timber comprising stocking green round wood or sawn timber under a cover, whereby respiratory and fermentation processes by fungi, bacteria, and respiratory processes of wood cells that are still alive are promoted, wherein the cover is absolutely air-tight and light tight and thereby the oxygen content inside the cover is less than 0.1 vol. % after an adjustment period of 3–10 days during the entire storage time, and the $CO_2$ content is higher than 21 and up to 40 vol. % which to a great extent prevents the growth of wood-destroying fungi, and the cover is a double, two-layered film whose black internal surface prevents the light from entering and thereby growth of algae, and whose white external surface reflects the sunlight.

2. Method according to claim 1 in which the films are welded either separately or simultaneously with double welds.

3. Method according to claim 1 in which the films are bonded with each other.

4. Method according to claim 1 in which the films are arranged plane on top of each other, clamped between two strips, tightly, wrapped around said strips, and secured using a clamping device.

5. Method according to claim 1 in which gas measuring flexible tubes that penetrate the films are attached to the films using bulkhead fittings.

6. Method according to claim 1 in which the bulkhead fittings are provided with extension hoses inside the cover, and the hose ends are at opposing ends inside the cover.

7. Method according to claim 6 in which measuring instruments are connected to the gas measuring flexible tubes through quick-connect couplings, with which measuring instruments the storage process can be checked via the gas composition.

8. Method for preservation storage of green round wood and sawn timber comprising stocking green round wood or sawn timber under a cover, whereby respiratory and fermentation processes by fungi, bacteria, and respiratory processes of wood cells that are still alive are promoted, wherein the cover is absolutely air-tight and light tight and thereby the oxygen content inside the cover is less than 0.1 vol. % after an adjustment period of 3–10 days during the entire storage time, and the $CO_2$ content is higher than 21 and up to 40 vol. % which to a great extent prevents the growth of wood-destroying fungi, wherein the cover is a doubled, two layered UV resistant plastic film.

9. Method for preservation storage of green round wood and sawn timber comprising stocking green round wood or sawn timber under a cover, whereby respiratory and fermentation processes by fungi, bacteria, and respiratory processes of wood cells that are still alive are promoted, wherein the cover is absolutely air-tight and light tight and thereby the oxygen content inside the cover is less than 0.1 vol. % after an adjustment period of 3–10 days during the entire storage time, and the $CO_2$ content is higher than 21 and up to 40 vol. % which to a great extent prevents the growth of wood-destroying fungi, wherein the cover is a two layered UV resistant plastic film.

10. Method for preservation storage of green round wood and sawn timber comprising stocking green round wood or sawn timber under a cover, whereby respiratory and fermentation processes by fungi, bacteria, and respiratory processes of wood cells that are still alive are promoted, wherein the cover is absolutely air-tight and light tight and thereby the oxygen content inside the cover is less than 0.1 vol. % after an adjustment period of 3–10 days during the entire storage time, and the $CO_2$ content is higher than 21 and up to 40 vol. % which to a great extent prevents the growth of wood-destroying fungi, wherein the cover is a doubled UV resistant plastic film.

11. Method for preservation storage of green round wood and sawn timber comprising stocking green round wood or sawn timber under a cover, whereby respiratory and fermentation processes by fungi, bacteria, and respiratory processes of wood cells that are still alive are promoted, wherein the cover is absolutely air-tight and light tight and thereby the oxygen content inside the cover is less than 0.1 vol. % after an adjustment period of 3–10 days during the entire storage time, and the $CO_2$ content is higher than 21 and up to 40 vol. % which to a great extent prevents the growth of wood-destroying fungi, wherein the cover is a UV resistant plastic film.

12. Method for preservation storage of green round wood and sawn timber comprising stocking green round wood or sawn timber under a cover, whereby respiratory and fermentation processes by fungi, bacteria, and respiratory processes of wood cells that are still alive are promoted, wherein the cover is absolutely air-tight and light tight and thereby the oxygen content inside the cover is less than 0.1 vol. % after an adjustment period of 3–10 days during the entire storage time, and the $CO_2$ content is higher than 21 and up to 40 vol. % which to a great extent prevents the growth of wood-destroying fungi, wherein gas measuring flexible tubes that penetrate the cover are attached to the cover using bulkhead fittings.

13. Method for preservation storage of green round wood and sawn timber comprising stocking green round wood or sawn timber under a cover, whereby respiratory and fermentation processes by fungi, bacteria, and respiratory processes of wood cells that are still alive are promoted, wherein the cover is absolutely air-tight and light tight and thereby the oxygen content inside the cover is less than 0.1 vol. % after an adjustment period of 3–10 days during the entire storage time, and the $CO_2$ content is higher than 21 and up to 40 vol. % which to a great extent prevents the growth of wood-destroying fungi, wherein before the beginning of the respiratory and fermentation processes, the volume of air inside the cover is minimized and gas measuring flexible tubes that penetrate the cover are attached to the cover using bulkhead fittings.

14. Method for preservation storage of green round wood and sawn timber comprising stocking green round wood or sawn timber under a cover, whereby respiratory and fermentation processes by fungi, bacteria, and respiratory processes of wood cells that are still alive are promoted, wherein the cover is absolutely air-tight and light tight and thereby the oxygen content inside the cover is less than 0.1 vol. % after an adjustment period of 3–10 days during the entire storage time, and the $CO_2$ content is higher than 21 and up to 40 vol. % which to a great extent prevents the growth of wood-destroying fungi, wherein, a rigid or flexible envelope is used as cover, whereby the space inside the cover is sealed air-tightly and light-tightly, from the environment and gas measuring flexible tubes that penetrate the cover are attached to the cover using bulkhead fittings.

15. Method for preservation storage of green round wood and sawn timber comprising stocking green round wood or sawn timber under a cover, whereby respiratory and fermentation processes by fungi, bacteria, and respiratory processes of wood cells that are still alive are promoted, wherein the cover is absolutely air-tight and light tight and thereby the oxygen content inside the cover is less than 0.1 vol. % after an adjustment period of 3–10 days during the entire storage time, and the $CO_2$ content is higher than 21 and up to 40 vol. % which to a great extent prevents the growth of wood-destroying fungi, wherein a single or double, UV-resistant plastic film with a high diffusion resistance is used as the cover and gas measuring flexible tubes that penetrate the cover are attached to the cover using bulkhead fittings.

16. Method for preservation storage of green round wood and sawn timber comprising stocking green round wood or sawn timber under a cover, whereby respiratory and fermentation processes by fungi, bacteria, and respiratory processes of wood cells that are still alive are promoted, wherein the cover is absolutely air-tight and light tight and thereby the oxygen content inside the cover is less than 0.1 vol. % after an adjustment period of 3–10 days during the entire storage time, and the $CO_2$ content is higher than 21 and up to 40 vol. % which to a great extent prevents the growth of wood-destroying fungi, wherein bulkhead fittings are provided with extension hoses inside the cover, and the hose ends are at opposing sides inside the cover.

17. Method according to claim 16 in which measuring instruments are connected to the gas measuring flexible tubes through quick-connect couplings, with which measuring instruments the storage process can be checked via the gas composition.

18. Method for preservation storage of green round wood and sawn timber comprising stocking green round wood or sawn timber under a cover, whereby respiratory and fermentation processes by fungi, bacteria, and respiratory processes of wood cells that are still alive are promoted, wherein the cover is absolutely air-tight and light tight and thereby the oxygen content inside the cover is less than 0.1 vol. % after an adjustment period of 3–10 days during the entire storage time, and the $CO_2$ content is higher than 21 and up to 40 vol. % which to a great extent prevents the growth of wood-destroying fungi, wherein before the beginning of the respiratory and fermentation processes, the volume of air inside the cover is minimized and bulkhead fittings are provided with extension hoses inside the cover, and the hose ends are at opposing sides inside the cover.

19. Method according to claim 18 in which measuring instruments are connected to the gas measuring flexible tubes through quick-connect couplings, with which measuring instruments the storage process can be checked via the gas composition.

20. Method for preservation storage of green round wood and sawn timber comprising stocking green round wood or sawn timber under a cover, whereby respiratory and fermentation processes by fungi, bacteria, and respiratory processes of wood cells that are still alive are promoted, wherein the cover is absolutely air-tight and light tight and thereby the oxygen content inside the cover is less than 0.1 vol. % after an adjustment period of 3–10 days during the entire storage time, and the $CO_2$ content is higher than 21 and up to 40 vol. % which to a great extent prevents the growth of wood-destroying fungi, wherein a rigid or flexible envelope is used as cover, whereby the space inside the cover is sealed air-tightly and light-tightly, from the environment and bulkhead fittings are provided with extension hoses inside the cover, and the hose ends are at opposing sides inside the cover.

21. Method according to claim 20 in which measuring instruments are connected to the gas measuring flexible tubes through quick-connect couplings, with which measuring instruments the storage process can be checked via the gas composition.

22. Method for preservation storage of green round wood and sawn timber comprising stocking green round wood or sawn timber under a cover, whereby respiratory and fermentation processes by fungi, bacteria, and respiratory processes of wood cells that are still alive are promoted, wherein the cover is absolutely air-tight and light tight and thereby the oxygen content inside the cover is less than 0.1 vol. % after an adjustment period of 3–10 days during the entire storage time, and the $CO_2$ content is higher than 21 and up to 40 vol. % which to a great extent prevents the growth of wood-destroying fungi, wherein a single or double, UV-resistant plastic film with a high diffusion resistance is used as the cover and bulkhead fittings are provided with extension hoses inside the cover, and the hose ends are at opposing sides inside the cover.

23. Method according to claim 22 in which measuring instruments are connected to the gas measuring flexible tubes through quick-connect couplings, with which measuring instruments the storage process can be checked via the gas composition.

* * * * *